US005186236A

United States Patent [19]

Gabathuler et al.

[11] Patent Number: 5,186,236

[45] Date of Patent: Feb. 16, 1993

[54] PROCESS FOR PRODUCING A LIQUID-SOLID METAL ALLOY PHASE FOR FURTHER PROCESSING AS MATERIAL IN THE THIXOTROPIC STATE

[75] Inventors: Jean-Pierre Gabathuler, Schleitheim; Kurt Buxmann, Sierre, both of Switzerland

[73] Assignee: Alusuisse-Lonza Services Ltd., Zurich, Switzerland

[21] Appl. No.: 806,150

[22] Filed: Dec. 12, 1991

[30] Foreign Application Priority Data

Dec. 21, 1990 [CH] Switzerland ..... 4090

[51] Int. Cl.[5] ..... B22D 27/08

[52] U.S. Cl. ..... 164/478; 164/71.1; 164/900

[58] Field of Search ..... 164/478, 71.1, 900

[56] References Cited

U.S. PATENT DOCUMENTS 4,564,059 1/1986 Dobatkin et al. .

FOREIGN PATENT DOCUMENTS

| | | | |
|---|---|---|---|
| 47-24338 | 7/1972 | Japan | 164/478 |
| 55-45558 | 3/1980 | Japan . | |
| 56-11134 | 2/1981 | Japan . | |
| 56-84156 | 7/1981 | Japan . | |
| 57-154350 | 9/1982 | Japan . | |
| 59-56952 | 4/1984 | Japan . | |
| 1523250 | 11/1989 | U.S.S.R. | 164/71.1 |

*Primary Examiner*—Kuang Y. Lin
*Attorney, Agent, or Firm*—Bachman & LaPointe

[57] ABSTRACT

An alloy melt having a solidified portion of primary crystals is maintained at a temperature between solidus and liquidus temperature of the alloy. The primary crystals are molded to give individual degenerated dendrites or cast grains of essentially globular shape and hence impart thixotropic properties to the liquid-solid metal alloy phase by the production of mechanical vibrations in the frequency range between 10 and 100 kHz in this liquid-solid metal alloy phase.

. 15 Claims, 1 Drawing Sheet

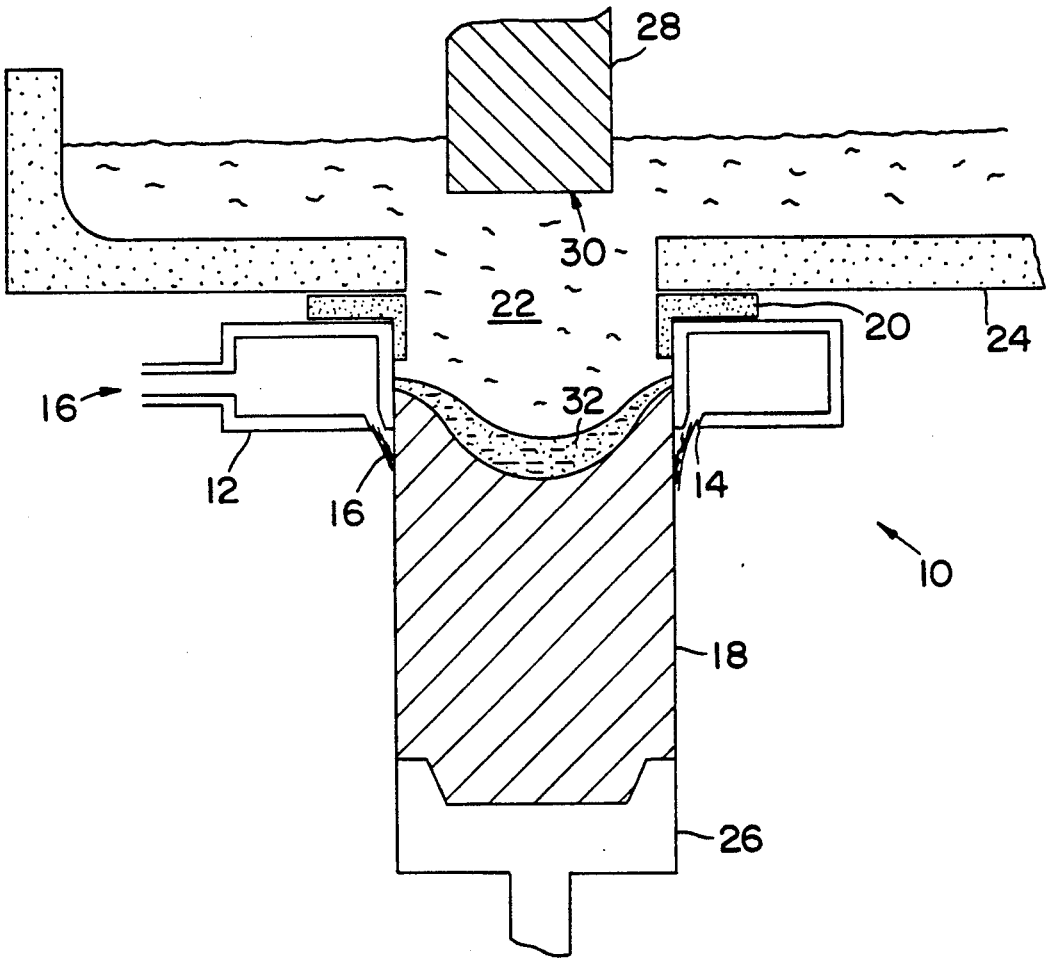
28
30
22
20
24
16
32
12
16
14
10
18
26

PROCESS FOR PRODUCING A LIQUID-SOLID METAL ALLOY PHASE FOR FURTHER PROCESSING AS MATERIAL IN THE THIXOTROPIC STATE

BACKGROUND OF THE INVENTION

The invention relates to a process for producing a liquid-solid metal alloy phase for further processing as material in the thixotropic state, wherein an alloy melt having a solidified portion of primary crystals is maintained at a temperature between solidus and liquidus temperature of the alloy, and the primary crystals are molded to give individual degenerated dendrites or cast grains of essentially globular shape.

It is known to set the temperature of an alloy melt to a value between solidus and liquidus temperature in the production of metal alloy phases having thixotropic properties, and to stir the alloy paste thus produced vigorously to convert the dendrites forming during the solidification process to give essentially globular cast grains. This process and the possibilities for use of the metal alloy phase having thixotropic properties thus produced is described in detail, for example in U.S. Pat. No. 3,948,650 and U.S. Pat. No. 3,959,651. The stirring effect is produced mechanically or electromagnetically. German Patentschrift 2 514 386 also discloses a process in which an alloy in billet or rod form is heated to a temperature between liquidus and solidus temperature and is maintained for a few minutes to hours at this temperature without stirring.

However, the three processes mentioned have considerable disadvantages. There is the danger for both mechanical as well as for electromagnetic stirring that, on the one hand oxide skins which form on the surface of the melt, and on the other hand air bubbles produced by vortex formation are stirred into the melt, and this is manifested in the end product by undesirable inclusions or porosity. In addition, a uniform cast grain size cannot be achieved using the two processes. Furthermore, effective stirring in the region of the solidification front of the alloy paste can only be implemented with difficulty using a mechanical stirring device for reasons relating to construction. The disadvantages caused by stirring may indeed be reduced in the process according to German Patentschrift 2 514 386, however, undesirable grain coarsening occurs due to the relatively long holding time of the alloy paste above solidus temperature.

SUMMARY OF THE INVENTION

In view of these conditions the inventors have set themselves the task of providing a process of the type discussed above, by means of which a metal alloy phase having thixotropic properties with as few oxide inclusions as possible, low porosity and uniform cast grain size may be produced and the treatment time of the alloy paste may be kept so short that there is no appreciable grain coarsening. In addition, the process should be simple to implement and favorable in terms of cost.

The object is solved in accordance with the invention in that mechanical vibrations in the frequency range between 10 and 100 kHz are produced in the liquid-solid metal alloy phase.

The vibrations lying preferably in the ultrasound frequency range between 18 and 45 kHz also effect homogenization and degassing of the melt, in addition to the required formation of fine, globular cast grains of uniform grain size in the partially solidified melt.

A further considerable advantage of the process of the invention resides in the fact that the "stirring effect" produced by the mechanical vibrations may be maintained virtually up to complete solidification of the alloy paste. This is in contrast to the mechanical or electromagnetic stirring which is effective only up to a primary crystal portion of approximately 65 wt. % in the alloy paste as a result of increasing viscosity of the alloy paste.

The mechanical vibrations in the alloy paste may be produced in any manner, thus for example via the die by coupling a vibration producer to the die frame. However, vibrations are preferably produced via the vibration surface of at least one vibration producer immersed directly in the metal melt, wherein the vibration amplitude of the vibration surface is between 5 and 100 μm, preferably between 20 and 60 μm.

The mechanical vibrations may be continuous or pulsating, wherein for pulsating vibration the pulse time is set preferably between 20 ms and 10 s, in particular between 0.1 s and 1 s, and the ratio of the pulse time of the mechanical vibrations to the off-time is between 0.1 and 1.

BRIEF DESCRIPTION OF THE DRAWING

The present invention will be more readily understandable from a consideration of the drawing in which:

The drawing represents a schematically shown, exemplary embodiment of the present invention.

DETAILED DESCRIPTION

The process of the invention can be used both for stationary die casting processes, such as die and sand casting, and for continuous processes, such as vertical and horizontal, conventional and electromagnetic continuous casting and strip casting processes of all types.

For strand casting the power introduced into the melt by the mechanical vibrations is preferably 2 to 50 $W/cm^2$ of strand cross-section, in particular 5 to 20 $W/cm^2$ of strand cross-section. The vibration surface of the vibration producer(s) is preferably 1 to 100%, in particular 10 to 60%, of the strand cross-section surface.

A piezoelectric vibration producer is advantageously used for producing mechanical vibrations, since the amplitude thereof may be set precisely independently of its power, and in addition greater amplitudes are possible than for magnetomechanical vibration producers.

Whereas for continuous casting processes the mechanical vibrations naturally act on the metal during the whole of the solidification process of the melt via the alloy paste up to complete solidification, for stationary casting processes it is sufficient for the mechanical vibrations to be introduced into the melt shortly before the onset of solidification. To achieve an optimum thixotropic structure, the vibrations are usually maintained until shortly before the onset of complete solidification of the melt.

The liquid-solid metal alloy phase produced using the process of the invention is generally initially cooled to below the solidus temperature of the alloy, generally to room temperature. The structure having the thixotropic properties is thus "frozen". For further processing of the material in a pressure casting machine or by other heat-remolding processes, such as forging or pressing, the thixotropic state of the alloy is produced again by renewed rapid heating to a temperature in the range between solidus and liquidus temperature of the alloy.

Of course the liquid-solid metal alloy phase having thixotropic properties may also be further processed directly after its production without prior complete solidification. When using continuous casting processes, the removal of heat is controlled in this case such that the minimum temperature of the paste does not drop below the solidus temperature of the alloy. Instead of a solid strand, the liquid-solid metal alloy phase is removed and further processed immediately.

It should be noted here that the term alloy is understood to also include the pure metals having impurities caused by the production, thus for example the various qualities of pure aluminum.

The process of the invention is particularly suitable for Producing thixotropic aluminum alloys. However, all castable alloy systems ,may be processed in principle.

Investigative experiments on an alloy of the type AlSi7Mg have shown that the ultrasound treatment of the liquid-solid phase leads not only to globular cast grains of uniform grain size, but at the same time it is possible to observe that the grains become finer. If a thixotropic structure having a still smaller cast grain size is required, an agent of known type for producing finer grain, such as for example titanium boride, may also be added to the melt. The results of the experiments are compiled in the table below.

| Fineness of grain (Titanium boride) | Ultrasound | |
|---|---|---|
| | without | with |
| without | 700–1000 μm | about 300 μm |
| with | 300–350 μm | about 150 μm |

Table: average cast grain diameter in AlSi7Mg

The process of the invention is illustrated in more detail below using an exemplary embodiment shown schematically in the figure.

A vertical continuous casting plant 10 has an interior-cooled die 12 arranged annularly, the gap-like opening 14 of which serves to introduce coolant 16 to the surface of the strand 18 emerging from the die 12. An insert 20 made from fire-resistant, heat-insulating material is arranged above the die 12 to form a so-called hot-top. The liquid metal 22 is fed to the die 12 via a casting channel 24. The strand 18 is continuously lowered by means of a start-up base 26 keeping the die 12 closed until the start of casting.

A vibration producer 28 with vibration surface 30 is immersed in the liquid metal 22 above the die. The mechanical vibrations, transferred to the liquid metal 22 by the vibration surface 30 of the vibration producer 28, lead to the formation of globular cast grains in the paste zone 32 between the liquid metal 22 and the solidified strand 18, and hence to the liquid-solid metal alloy phase having thixotropic properties.

We claim:

1. Process for producing a liquid-solid metal alloy phase for further processing as material in the thixotropic state, which comprises: maintaining an alloy melt having a solidified portion of primary crystals at a temperature between solidus and liquidus temperature of the alloy; producing mechanical vibrations in the frequency range between 10 and 100 KHz in the liquid-solid metal alloy phase; and molding the primary crystals, which have a structure of degenerated dendrites or casting grains of essentially globular shape, into an ingot.

2. Process according to claim 1 wherein the frequency of the mechanical vibrations is in the ultrasound range between 18 and 45 KHz.

3. Process according to claim 1 including the step of producing the mechanical vibrations via the vibration surface of at least one vibration producer immersed directly in the metal melt.

4. Process according to claim 3 wherein the vibration amplitude of the vibration surface is between 5 and 100 μm.

5. Process according to claim 4 wherein said vibration amplitude is between 20 and 60 μm.

6. Process according to claim 1 wherein the mechanical vibrations are pulsating.

7. Process according to claim 6 wherein the ratio of the pulse time of the mechanical vibrations to the off-time is between 0.1 and 1.

8. Process according to claim 6 wherein the pulse time is set between 20 ms and 10 s.

9. Process according to claim 8 wherein the pulse time is set between 0.1 s and 1 s.

10. Process according to claim 1 including the steps of continuously strand casting and wherein the power introduced into the metal melt by the mechanical vibrations is 2 to 50 $W/cm^2$ of strand cross-section.

11. Process according to claim 10 wherein the power introduced into the metal melt by the mechanical vibrations is 5 to 20 $W/cm^2$ of strand cross-section.

12. Process according to claim 3 wherein the vibration surface of said at least one vibration producer is 1 to 100% of the strand cross-section surface.

13. Process according to claim 12 wherein the vibration surface of said at least one vibration producer is 10 to 60% of the strand cross-section surface.

14. Process according to claim 10 wherein the vibration surface of said at least one vibration producer is 1 to 100% of the strand cross-section surface.

15. Process according to claim 1 wherein the mechanical vibrations are produced using a piezoelectric vibration producer.

* * * * *